US005871342A

United States Patent [19]

Harte et al.

[11] Patent Number: 5,871,342

[45] Date of Patent: Feb. 16, 1999

[54] VARIABLE CAPACITY ROLLING PISTON COMPRESSOR

[75] Inventors: Shane Anthony Harte, Dearborn; Vipen Kumar Khetarpal, Novi; Guntis Viktors Strikis, Belleville, all of Mich.

[73] Assignee: Ford Motor Company, Dearborn, Mich.

[21] Appl. No.: 871,089

[22] Filed: Jun. 9, 1997

[51] Int. Cl.[6] ..... F04C 18/356; F04C 23/00; F04C 29/10

[52] U.S. Cl. ..... 418/6; 418/11; 418/23

[58] Field of Search ..... 418/6, 11, 23, 418/61.1, 63

[56] References Cited

U.S. PATENT DOCUMENTS

| | | | |
|---|---|---|---|
| 3,139,036 | 6/1964 | McGill | 418/63 |
| 3,904,321 | 9/1975 | Ruedi et al. | 417/283 |
| 4,397,618 | 8/1983 | Stenzel | 418/23 |
| 4,522,573 | 6/1985 | Shibuya | 418/23 |
| 5,015,161 | 5/1991 | Amin et al. | 418/6 |
| 5,131,826 | 7/1992 | Boussicault | 418/23 |
| 5,284,426 | 2/1994 | Strikis et al. | 418/6 |
| 5,472,327 | 12/1995 | Strikis et al. | 418/6 |

FOREIGN PATENT DOCUMENTS

| | | | |
|---|---|---|---|
| 57-179394 | 11/1982 | Japan | 418/23 |
| 57-179395 | 11/1982 | Japan | 418/23 |
| 60-22086 | 2/1985 | Japan . | |
| 62-271985 | 11/1987 | Japan | 418/63 |
| 63-189683 | 8/1988 | Japan | 418/63 |
| 3-185292 | 8/1991 | Japan . | |

*Primary Examiner*—John J. Vrablik
*Attorney, Agent, or Firm*—Donald A. Wilkinson

[57] ABSTRACT

A variable capacity rotary compressor (12) having a housing (14) with a cylindrical chamber (16) and an orbiting ring piston (26) in the chamber. A pair of outer vanes (20) slidably mount in the housing and are biased into engagement with the orbiting ring (26), forming a pair of gas chambers (27). A pair of vane deactivation assemblies (52) each include a deactivation pin (58) which engages a deactivation recess (60) in its respective outer vane (20) when a corresponding one or both solenoid actuators (54) are energized. The pins (58) hold the outer vanes (20) in a retracted position out of contact with the orbiting ring (26), thus reducing the capacity of the compressor (12). Each outer vane (20) includes a slotted recess (62) adjacent to its deactivation recess (60) in order to allow for plastic yielding of the vane (20) behind the deactivation recess (60) without the yielded material interfering with the sliding motion of the outer vanes (20) relative to the walls of corresponding vane slots (18).

6 Claims, 2 Drawing Sheets

VARIABLE CAPACITY ROLLING PISTON COMPRESSOR

FIELD OF THE INVENTION

The present invention relates to a refrigerant gas compressor having a variable capacity and more particularly to a variable capacity rotary piston compressor for automotive climate control systems.

BACKGROUND OF THE INVENTION

Vehicle air conditioning compressors are generally powered by an accessory belt taking power from the engine, with a clutch controlling when the compressor is driven at full capacity by the engine and when it is disconnected. One of the concerns with this conventional arrangement is that the compressors operate at full capacity at all times the clutch is engaged. This is not optimal for some driving conditions, and thus, some air conditioning systems have taken to cycling the compressor clutch on and off. However, this can create stumble in the engine operation, thus degrading the ride for the vehicle occupants. Consequently, others have attempted to vary the capacity of the compressor itself during operation, in one way or another, in order to allow for a more optimal compressor output, without having to cycle the compressor clutch on and off as frequently.

Some vehicle air conditioning systems use rotary compressors which employ vanes for sealing around an eccentric rotary member to compress the refrigerant. This particular type of air conditioning compressor employs an eccentric rotating part rotating in a cavity with vanes sealing against it to form pump cavities (gas chambers) for compressing the refrigerant. Rolling piston compressors operate on the principle that refrigerant gas is trapped and compressed between a rotating rotor and a reciprocating vane. If the vane is restrained from moving, then, the compressor displacement (i.e., capacity) will be reduced. One way to accomplish this is with a solenoid, which when energized causes an armature to contact the vane and prevent its movement from a retracted position. This locks the vane away from the rolling piston so that its edge does not bear on the rolling piston, thus exposing the outlet port to the inlet port and preventing compression. An example of a system such as this is disclosed in U.S. Pat. No. 4,397,618 to Stenzel.

In a rolling piston compressor, generally, the width of a compressor vane is held to very tight tolerances as is the slot within which it slides in order to allow for a snug fit, creating sealing between the two. A concern arises with the use of an armature being employed to stop the motion of the vane during periods of vane deactivation in that the armature may cause deformation in the surface of the vane as the two repeatedly engage and disengage. There is potential, when the armature is actuated, that as it stops the vane movement (causing impact between the back of the hole and the armature), this impact of the armature with the back of the hole in the vane will cause the material at the back of the hole (i.e., on the spring side of the hole) to yield and deform somewhat through normal usage and extend outward like a small burr on the vane surface. Any deformation which causes the surface of the vane to extend outward forming a burr can increase wear between the vane and the slot, due to the tight clearance, and even possibly cause one to jam relative to the other. The result of the rubbing of the burr on the vane wall, then, may be that the maximum capacity of the compressor is reduced.

SUMMARY OF THE INVENTION

In its embodiments, the present invention contemplates a variable capacity rotary compressor including a housing having an inner wall defining a cylindrical chamber and having an inlet for drawing in a medium which is to be compressed and an outlet for the delivery of the compressed medium from the cylindrical chamber. An orbiting ring piston has an outer cylindrical surface and is adapted to be supported within the housing so as to be freely rotatable on the inner wall of the housing in an eccentric manner relative to the cylindrical chamber. A vane spring is mounted in the housing, and at least one vane is slidably supported in the housing and resiliently urged in a first direction by the action of the spring against the outer cylindrical surface of the ring piston. The vane is disposed between the inlet and the outlet, and vane has a deactivation recess, and a free edge adjacent the ring piston. The compressor further includes a deactivation assembly for locking the vane in a deactivated position in which the free edge does not bear on the outer cylindrical surface of the ring piston, at least during one part of the ring piston motion. The deactivation assembly includes a deactivation pin which is slidable transversely relative to the direction of vane movement, between a first position, in which it releases the vane, and a second position in which it fixes the vane in the deactivated position; and the vane has a slotted recess adjacent the deactivation recess whereby any deformation of the deactivation recess caused by contact with the deactivation pin will occur within the slotted recess.

Accordingly, an object of the present invention is to allow for deactivation of one or more vanes in a rolling piston compressor while maintaining an optimal operative engagement between the deactivatable vane and the vane slot within which it slides.

An advantage of the present invention is that a vane in a rolling piston compressor can be deactivated by a deactivation pin without excessive wear concerns between the deactivatable vane and the wall of the corresponding vane slot around the pin location.

Detailed Description Of The Preferred Embodiments

Figure 1:
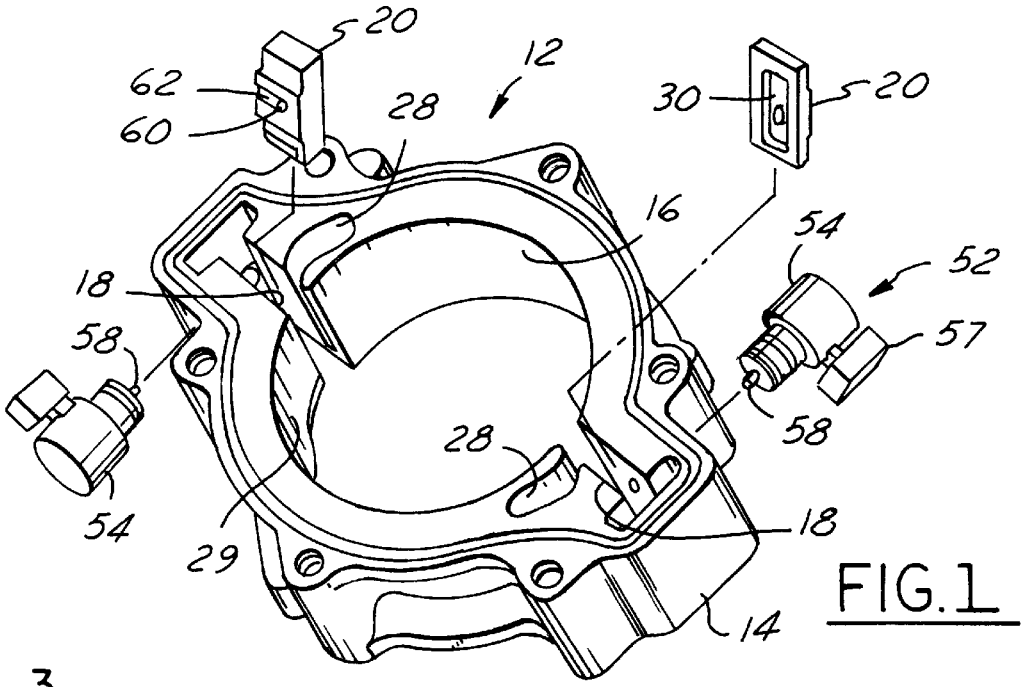
FIG. 1 is a partially exploded perspective view of a center portion of a compressor, in accordance with the present invention.
Figure 2:
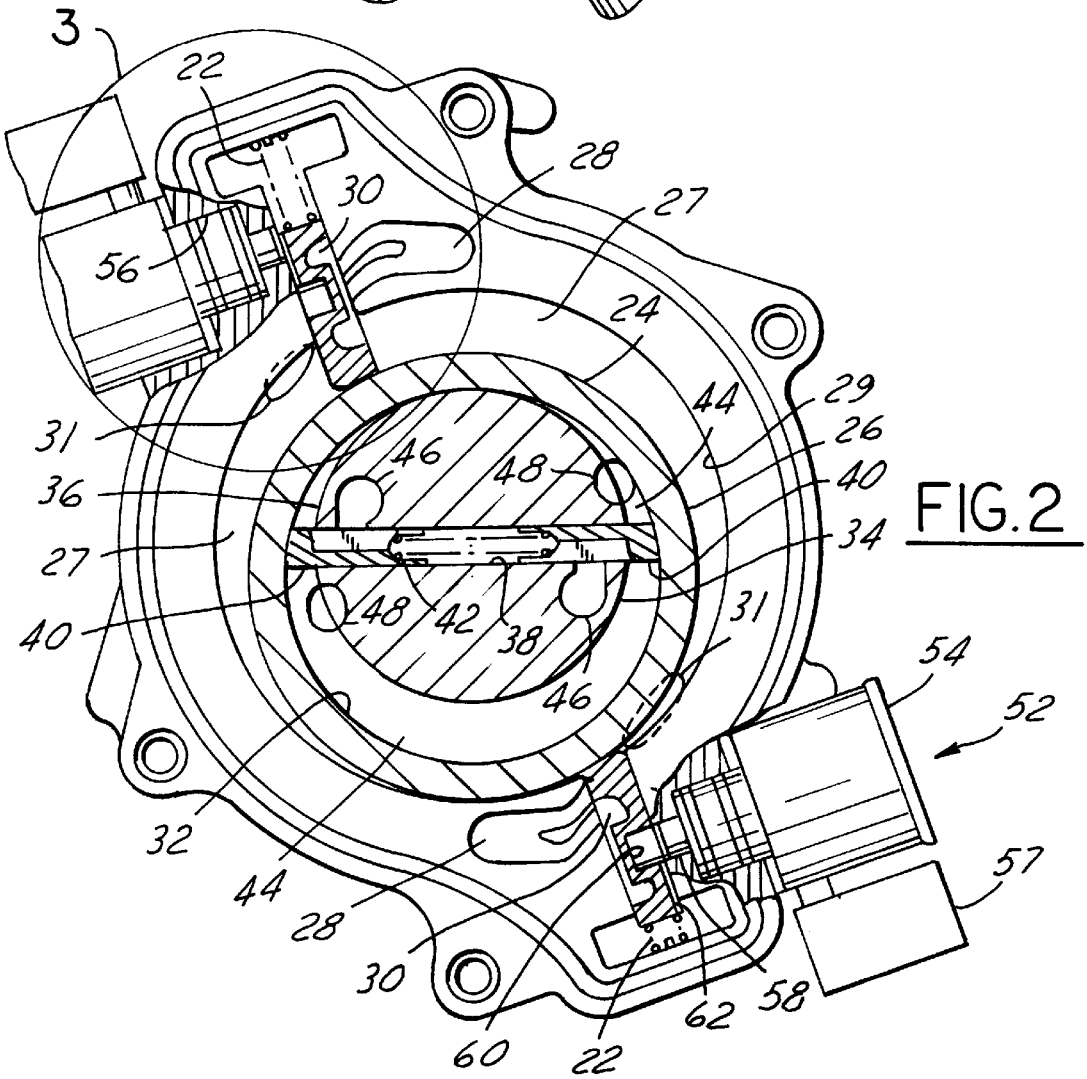
FIG. 2 is a front view of a portion of the compressor in accordance with the present invention.
Figure 3:
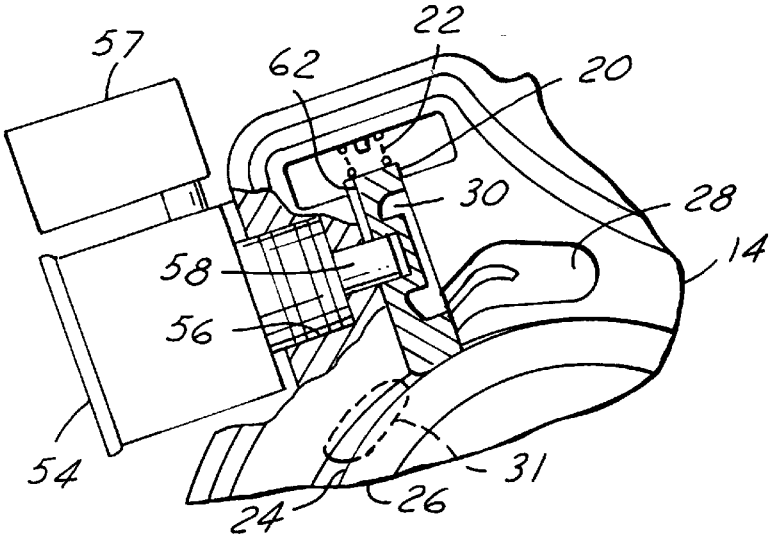
FIG. 3 is an enlarged view of encircled area 3 in FIG. 2, with the orbiting ring piston shown in a rotationally different position.
Figure 4:
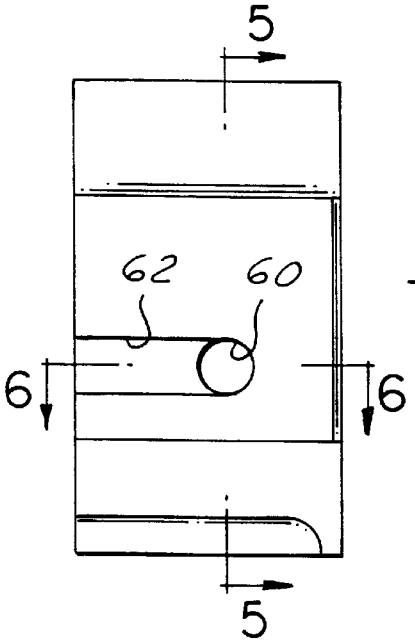
FIG. 4 is a front view of a vane in accordance with the present invention.
Figure 5:
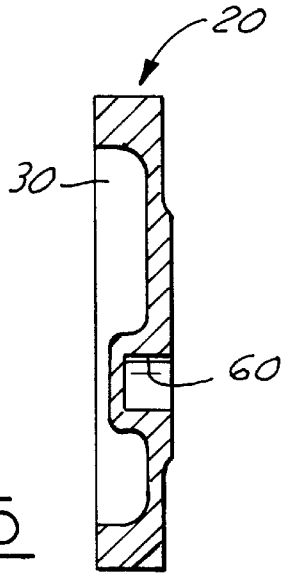
FIG. 5 is a sectional view taken along line 5—5 in FIG. 4.
Figure 6:
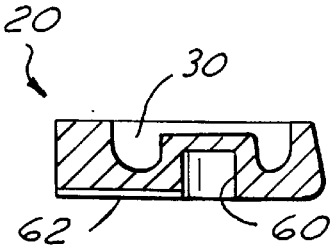
FIG. 6 is a sectional view taken along line 6—6 in FIG. 4.

FIGS. 1–6 illustrate a portion of a multi-stage rotary compressor 12. For a more complete description of other aspects of the compressor 12, one is referred to U.S. Pat. No. 5,015,161 and 5,284,426 assigned to the assignee of this invention, and incorporated herein by reference. The portion of the compressor includes a housing 14 having a cylindrical main chamber 16 with a pair of outer vane slots 18 extending therefrom. A pair of outer vanes 20 are slidably mounted in a respective one of the vane slots 18. Each vane 20 has an associated vane spring 22 biasing it into the main chamber 16 against an outer cylindrical surface 24 of an orbiting ring piston 26, also located in the chamber 16. The contact of the outer vanes 20 with the cylindrical surface 24 forms a pair of outer (first stage) gas chambers 27 located between the inner cylindrical surface 29 of the main chamber 16 and the outer cylindrical surface 24 of the orbiting ring piston 26. The width of each of the vanes 20 is held to very tight tolerances as are the respective slots 18 within which they slide. This allows for good sealing between each vane 20 and slot 18 to maintain separation of gasses on either side of each vane 20.

The housing 14 also includes a pair of first stage suction ports 28 in communication between a refrigerant inlet, not shown, and respective outer vane slots 18. Each of the outer vanes 20 includes a valve recess 30 which registers with its corresponding suction port 28. When one of the outer vanes 20 moves in a radially inward direction, the recess 30 in that vane 20 provides communication between its suction port 28 and one of the outer gas chambers 27. Additionally, a pair of first stage outlet ports 31, one each, are located in a respective one of the pair of outer gas chambers 27.

The orbiting ring piston 26 also has a cylindrical inner surface 32 which surrounds and mates with a cylindrical post 34. The cylindrical post 34 has a cylindrical outer surface 36 that is concentric and fixed with respect to the inner cylindrical surface 29 of the main chamber 16. The outer surface 36 of the post 34 is in partial engagement with the inner cylindrical surface 32 of the ring piston 26.

An inner vane slot 38 extends diametrically through the cylindrical post 34. A pair of inner vanes 40 are mounted in the inner vane slot 38, with a spring 42 located between them, biasing the inner vanes 40 outward into surface contact with the inner surface 32 of the ring piston 26. The inner vane contact with the inner surface 32 forms a pair of inner (second stage) gas chambers 44 located between the inner cylindrical surface 32 of the ring piston 26 and the outer cylindrical surface 36 of the post 34. A pair of second stage inlet (suction) ports 46 communicate with the first stage outlet ports 31 through internal passages, not shown, to supply gas to the second stage gas chambers 44. A pair of second stage outlet ports 48 allow the compressed gas to exit the second stage gas chambers 44 during compressor operation.

It is apparent that the compressor 12 is configured so that the pump action at full capacity occurs in two stages. Each stage has two gas pumping chambers. The compression chambers 27 for the first stage discharge into the inlet ports 46 for the second stage compression chambers 44. The gases compressed in the first stage, then, are compressed further in the second stage before leaving the compressor 12. Thus, if a portion or all of the stages do not act to compress the gas, then the capacity of the compressor is reduced.

A deactivation assembly 52 is shown for each of the outer vanes 20. The assemblies 52 each include a solenoid actuator 54 located in an actuator opening 56 formed in the housing 14. An electrical connector 57 is adapted to be connected to a conventional electrical power source, not shown, to electrically energize the solenoid 54. A deactivation pin 58 protrudes from each of the solenoid actuators 54 and is spring biased toward a retracted position relative to its associated actuator 54. The pin 58 acts as the armature of the solenoid actuator 54. Each of the outer vanes 20 includes a deactivation recess 60 which aligns with its corresponding pin 58 when the corresponding outer vane 20 is retracted into its outer vane slot 18.

The pin 58 is extended outward toward its corresponding outer vane 20 by energizing the solenoid actuator 54. The next time the corresponding outer vane 20 is retracted, the pin 58 will enter the deactivation recess 60, which will interrupt communication between the associated suction port 28 and the outer gas chambers 27. This effectively disables one of the outer vanes 20. Thus, only a single outer gas chamber 27 in the first stage is operable, which reduces the capacity of the compressor.

By disabling one of the outer vanes 20, the capacity of the compressor 12 is reduced to about 65–75% of its maximum capacity. Reducing the effective displacement in this way conserves compressor energy. Of course, the other solenoid actuator 54 can be used to deactivate the other outer vane 20 as well. If both outer vanes 20 are deactivated, the pumping capacity of the compressor is reduced to about 45–55% of its maximum capacity, more or less, of course depending upon the ratio of volumes between the two stages. Thus, it is possible to better tailor the pump capacity to the actual operating requirements of the compressor, thereby conserving energy.

Each deactivation recess 60 located in its associated outer vane 20 is adjacent to a corresponding slotted recess 62. Each of the slotted recesses 62 extends from its corresponding deactivation recess 60 in a direction toward the associated vane spring 22. Since the vane springs 22 bias the outer vanes 20 in a direction opposite the springs 22, the impact of the deactivation pin 58 in the deactivation recess 60 will be on this side of the recess 60. In this way, any material deformation which may occur due to the deactivation pin contact when it is actuated will occur within the slotted recesses 62. Now, if some of the material at the back of the deactivation recess 60 yields due to normal cycling of the deactivation pin 58 into and out of the recess 60, the burr formed will not rub on the surface of the vane slot 18, while still allowing for sealing between the vane 20 and the slot 18. The depth of the slotted recesses 62 need only be about 0.2 to 0.5 millimeters deep into the surface of the outer vanes 20 in order to be effective, although different depths may be desirable depending upon the material and thickness of the vane and other general design parameters.

While the compressor illustrated in this embodiment is a multi-stage rotary compressor having a variable capacity mechanism, it is more generally applicable to most rolling piston compressors employing vanes and a similar variable capacity mechanism.

Figure 7:
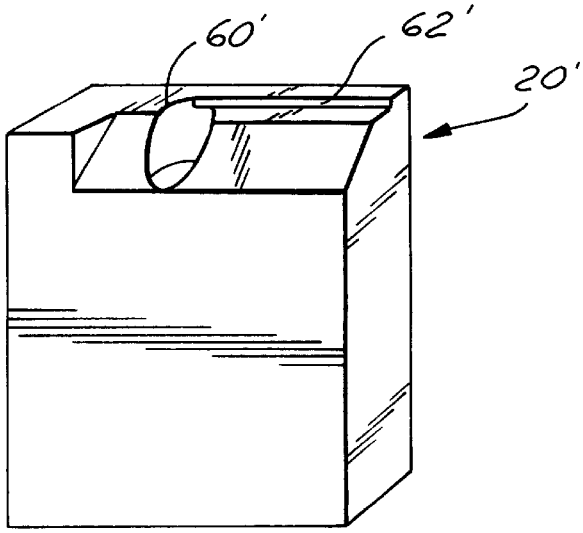
FIG. 7 is an alternate embodiment of a vane in accordance with the present invention.

A second embodiment is illustrated in FIG. 7. In this embodiment, the elements that are similar to elements referenced in the first embodiment will be similarly designated, but with an added prime. The deactivation recess 60' is now oriented on a side of the outer vane 20', 90° different from that shown in the first embodiment. Of course, the associated deactivation pin and solenoid actuator, not illustrated, would also be oriented 90° different from the first embodiment. The reason for orienting the pin and recess differently may be that it is more convenient to mount the deactivation assembly at this orientation in the compressor housing for packaging or ease of manufacture considerations. The same concern still arises, however, in that a plastic deformation at the back of the hole may cause a burr which would rub on the corresponding vane slot wall. Thus, a slotted recess 62' is formed in the vane 20' adjacent the deactivation recess 60' in order accommodate any deformation which may occur, while still allowing for a good seal between the vane 20' and its corresponding vane slot.

While certain embodiments of the present invention have been described in detail, those familiar with the art to which this invention relates will recognize various alternative designs and embodiments for practicing the invention as defined by the following claims.

We claim:

1. A variable capacity rotary compressor comprising:

a housing having an inner wall defining a cylindrical chamber and having an inlet for drawing in a medium which is to be compressed and an outlet for the delivery of the compressed medium from the cylindrical chamber;

an orbiting ring piston having an outer cylindrical surface and adapted to be supported within the housing so as to be freely rotatable on the inner wall of the housing in an eccentric manner relative to the cylindrical chamber;

a vane spring mounted in the housing;

at least one vane slidably supported in the housing and resiliently urged in a first direction by the action of the spring against the outer cylindrical surface of the ring piston, with the vane being disposed between the inlet and the outlet, and having a deactivation recess, and a free edge adjacent the ring piston;

a deactivation assembly for locking the vane in a deactivated position in which the free edge does not bear on the outer cylindrical surface of the ring piston, at least during one part of the ring piston motion, with the deactivation assembly including a deactivation pin which is slidable transversely relative to the direction of vane movement, between a first position, in which it releases the vane, and a second position in which it fixes the vane in the deactivated position; and the vane having a slotted recess adjacent the deactivation recess whereby any deformation of the deactivation recess caused by contact with the deactivation pin will occur within the slotted recess.

2. The variable capacity rotary compressor of claim 1 wherein the compressor is a two stage compressor further comprising:

a post substantially coaxial with the cylindrical chamber, having a cylindrical surface spaced from the inner wall, with a transverse slot in the post;

the ring piston further including an inner cylindrical surface in contact with the cylindrical surface of the post in an eccentric manner relative to the post; and an inner vane mounted in the transverse slot for movement into contact with the inner cylindrical surface of the ring piston.

3. The variable capacity rotary compressor of claim 1 further comprising:

a second vane spring mounted in the housing;

a second vane slidably supported in the housing and resiliently urged in a first direction by the action of the second spring against the outer cylindrical surface of the ring piston;

the housing having a second inlet and a second outlet operatively engaging the second vane;

the second vane being disposed between the second inlet and the second outlet, with the second vane having a second deactivation recess and having a free edge adjacent the ring piston;

a second deactivation assembly for locking the second vane in a deactivated position in which the free edge does not bear on the outer cylindrical surface of the ring, at least during one part of the ring piston motion, with the second deactivation assembly including a second deactivation pin which is slidable transversely relative to the direction of the second vane movement, between a first position, in which it releases the second vane, and a second position in which it fixes the second vane in the deactivated position; and the second vane having a slotted recess adjacent the deactivation recess whereby any deformation of the deactivation recess caused by contact with the deactivation pin will occur within the slotted recess.

4. The variable capacity rotary compressor of claim 1 wherein the slotted recess extends about 0.20 to 0.50 millimeters into the surface of the vane.

5. A variable capacity rotary compressor comprising:

a compressor housing, a compression chamber formed in the housing, the chamber having a cylindrical inner surface with a first geometric axis;

an orbiting ring piston mounted for orbiting movement about a second geometric axis that is offset relative to the first geometric axis, the orbiting ring piston having an outer surface adapted to contact the compression chamber inner surface;

outer vanes carried by the housing and adapted to move into engagement with the orbiting ring piston outer surface to define a first and a second compression chamber portion, with each of the outer vanes including a deactivation recess;

a first and a second first stage inlet port in the housing communicating with the first and the second compression chamber portions, and first and second second-stage outlet ports in the housing;

deactivation assembly for selectively disabling each of the outer vanes whereby the outer vanes are held against movement into engagement with the orbiting ring piston, with the deactivation assembly comprising first and second solenoid actuator means carried by the housing, including a first and a second deactivation pin respectively, the first and the second solenoid actuator means for respectively shifting first and second ones of the deactivation pins toward and away from the deactivation recess in the outer vanes; and each of the outer vanes further including slotted recesses adjacent the respective deactivation recess whereby any deformation of the deactivation recess caused by contact with the deactivation pin will occur within the slotted recess.

6. A two-stage, variable capacity rotary gas compressor comprising:

a housing, with a compressor cavity in the housing having an internal cylindrical surface with a first axis;

a post substantially coaxial with the first axis, having a cylindrical surface spaced radially from the internal surface, with a transverse slot in the post;

an orbiting ring piston mounted for rotary movement about a second axis displaced radially from the first axis, the ring piston being located in the cavity between the internal surface and the post, with the ring piston having an outer cylindrical surface in contact with the internal surface and an inner cylindrical surface in contact with the post;

an outer vane slot in the housing, an outer vane mounted for movement in the slot into contact with the outer cylindrical surface of the ring piston, with the outer vane including a deactivation recess oriented normally to the direction of movement of the outer vane;

an inner vane mounted in the transverse slot for movement into contact with the inner cylindrical surface of the ring piston;

a first stage inlet passage adapted to be opened and closed by movement of the outer vane in the outer vane slot;

a second stage inlet passage adapted to be opened and closed by movement of the inner vane in the transverse slot;

a first stage discharge port in the housing communicating with the second stage inlet passage;

deactivation assembly for disabling the outer vane to prevent its movement into contact with the outer cylindrical surface whereby the capacity of the compressor can be reduced with an accompanying reduction in torque required to drive the ring piston, with the deactivation assembly including a solenoid actuator means carried by the housing, including a deactivation pin extending therefrom, for selectively moving the deactivation pin into and out of the deactivation recess in the outer vane; and the outer vane including a slotted recess adjacent the deactivation recess, located opposite the deactivation recess from the outer cylindrical surface of the ring piston.

* * * * *